US005865260A

United States Patent [19]

Jackson et al.

[11] Patent Number: 5,865,260

[45] Date of Patent: Feb. 2, 1999

[54] METHOD AND APPARATUS FOR DRILLING MULTIPLE WELLS FROM A PLATFORM

[75] Inventors: John R. Jackson, Houston; Noel S. Avocato, Austin, both of Tex.; Alan Leiper, Aberdeen, Scotland; Jan Wiersma, West Zann, Netherlands

[73] Assignee: Chevron U.S.A. Inc., San Francisco, Calif.

[21] Appl. No.: 750,651

[22] PCT Filed: Aug. 30, 1996

[86] PCT No.: PCT/US96/13860

§ 371 Date: Dec. 18, 1996

§ 102(e) Date: Dec. 18, 1996

[87] PCT Pub. No.: WO97/09508

PCT Pub. Date: Mar. 13, 1997

Related U.S. Application Data

[60] Provisional application No. 60/003,163, Sep. 1, 1995.

[51] Int. Cl.[6] ..... E21B 7/12; E21B 7/04

[52] U.S. Cl. ..... 175/5; 166/358; 175/61

[58] Field of Search ..... 175/5, 7, 9, 61, 175/78, 79; 166/358

[56] References Cited

U.S. PATENT DOCUMENTS

| | | |
|---|---|---|
| 1,900,163 | 3/1933 | Dana et al. . |
| 4,136,996 | 1/1979 | Burns . |
| 4,561,802 | 12/1985 | Campo . |
| 5,458,199 | 10/1995 | Collins et al. . |
| 5,560,435 | 10/1996 | Sharp . |

*Primary Examiner*—Hoang C. Dang
*Attorney, Agent, or Firm*—Burns, Doane, Swecker & Mathis, L.L.P.

[57] ABSTRACT

A facility or platform (11) having a limited number of circular well-drilling slots (3) is converted to provide additional well-drilling locations on the platform (11) while protecting the platform (11) from the hoisting and lowering loads normally required to drill deep water wells. The additional well-drilling locations are provided by placing multiple wells in individual slots (3). Load protection is accomplished by transferring such loads to a underwater competent earth formation (15) with a thick-walled shroud (12). The shroud (12) surrounding the multiple wells carries at minimum by a plurality of internal centers through which the wells pass for assuring separation of the multiple wells and transmitting loads to the shroud (12).

12 Claims, 11 Drawing Sheets

METHOD AND APPARATUS FOR DRILLING MULTIPLE WELLS FROM A PLATFORM

This application claims priority to and the benefit of PCT International Application No. US/96/13960, filed Aug. 30, 1996, and U.S. Provisional Application Ser. No. 60/003,163, filed Sep. 1, 1995, now abandoned.

FIELD OF THE INVENTION

The present invention is directed to apparatus and a method for substantially reducing the costs of drilling and producing petroleum from underwater reservoirs.

More particularly, it relates to increasing the number of wells that can be drilled from a deep water platform having limited facilities to drill single wells through a multiplicity of "slots" by providing multiple wells in close proximity to one another (close proximity wells or "CPWs") in individual slots.

SUMMARY OF THE INVENTION

In accordance with the present invention, a facility or platform having a limited number of circular well-drilling slots is converted to provide additional well-drilling locations on the platform while protecting the platform from the hoisting and lowering loads normally required to drill deep water wells. This load protection is accomplished by transferring such loads to an underwater competent earth formation. To utilize a competent formation, an annular shroud (also referred to as a caisson or a drive pipe) having an outer diameter slightly smaller than the generally circular slot but large enough to accommodate multiple close proximity wells is extended downwardly through a platform slot and typical unconsolidated, underwater formations.

The wall thickness of the shroud is adequate to provide a heavy-wall pipe structure that can be driven to a "refusal" depth by an underwater hammer alone, or with aid of a rotary excavator. Preferably, the driven end of the shroud includes a surrounding "shoe" to aid and protect the driven edge of the shroud. In this way, the outer surface of the shroud is vertically supported over the full penetration depth in the competent formation. The upper end of the shroud can pass through the slot, but it is not connected thereto.

After the shroud is driven to its final depth, the enclosed detritus is excavated to form clear interior open space within the shroud. This open space is then configured to provide weight-bearing support for two or more separate CPWs. A series of internal guides are inserted within the excavated shroud. These guides each carry two or more axially-oriented parallel cylindrical apertures, one for each of the CPWs to pass through. The guides are locked in place with guide locks against the internal wall of the shroud. The guides are spaced apart from each other vertically over the length of the shroud and are aligned with one another so that their two or more apertures together define a series of two or more separate and distinct parallel cylindrical paths running from the lower end of the shroud to the drill platform. A multiple bore drill head is then installed, supported on the upper end of the shroud. Casings (also referred to as conductor strings) for the individual CPWs are then run through the distinct parallel paths defined by the guides. The weight of the conductor strings is suspended from the shroud. The largest of these conductor strings are generally somewhat less than half the diameter of the outer shroud.

The outer edges of the guides are supported on the inner wall of the shroud with their apertures positioned to create as much space between the two conductor strings as possible. In this way, the two or more conductor strings pass through the boreheads and down through the guides spaced along the shroud to the bottom of the shroud without becoming entangled.

These conductor strings are drilled or driven into the competent formation as the next step of the process. This drilling/driving can take place after one conductor string has been run to the bottom of the shroud or it can be commenced when the several conductor strings have been put in place in the shroud.

To anchor the conductor strings for drilling of the well from the bottom of the shroud, one or more guides generally of the type already described can be positioned in the shroud at or near its lower end, that is, at about the well kick-off point. In addition to properly spacing the conductor strings from one another, these down-hole guides also assure that before actual drilling from the bottom end of the shroud, the conductor strings are properly oriented toward their desired path to reach their respective production or injection sectors of the petroleum reservoir.

In sequence, then, after setting the guides in the shroud, a dual borehead is extended across the diameter of the shroud. The borehead has at least two (but generally two) sleeves of generally equal diameters but less than one half of the internal diameter of the shroud. Each of the outer diameters of the boreheads is positioned at the inner surface of the shroud so that there is maximum space between the opposed sleeves. Conductor strings are fed into the opposed sleeves and down through apertures in the previously installed guides.

Dual guide sleeves guide the conductor strings through the respective apertures in the guides along opposite sides of the shroud wall. If desired, the apertures of the guides may be keyed to accept only a selected conductor string. Then, when both conductor strings have been captured by their respective cylindrical apertures in the guides, one of the strings is suspended from the sleeve guide while the other string is drilled toward its objective. Typically, a series of decreasing-diameter concentric conductors or tubing strings are employed in sequential fashion to complete the drilling process of the CPWs to reach the object formation. These several casings and tubings extend below the shroud base to the respective desired depths. Each conductor string section is sealed or cemented as needed to seal it to adjacent concentric strings.

The other conductor string previously suspended on the shroud is similarly extended to its desired location, either laterally or deeper, in the producing formation. The second conductor string is sealed generally threadably along its length from the well bore bottom and through the space between the various casing strings and along the surface of the shroud, but at least into the annular shroud (caissons).

It will be appreciated that the drilling sequence between the two CPWs can be varied as desired. For example, it is possible to complete a series of drilling steps on a single member of the paired CPWs before beginning the sequence on the second member, or it is possible to first complete a single drilling step on both CPWs before moving to the next step.

Finally, the wells are completed by constructing well heads and Christmas trees on top of their conductor strings.

The foregoing steps permit multiple wells to be drilled from a single slot on an offshore drilling platform while also permitting substantially all loads in the drilling and producing operations to be supported by the competent formation rather than by the drilling platform. These loads include the several conductor strings, including the conductor casings and tubing strings, drilling tools and blowout preventers, as well as the wellheads and Christmas trees which are located on top of them above the platform deck.

DESCRIPTION OF A PREFERRED EMBODIMENT OF THE INVENTION

The invention was first embodied in a plurality of producing oil wells and a pair of injection wells in an oil field called Alba, located in Block 16/26 of the UK Continental Shelf. The field lies about 130 miles north-east of Aberdeen in 453 feet of water. The reservoir is a long, narrow Eocene sandstone deposit located at a depth of approximately 6,300 feet TVD (total vertical depth). The field was discovered by the 16/26 S well in 1984 and field development plans were initiated in 1987.

Figure 2:
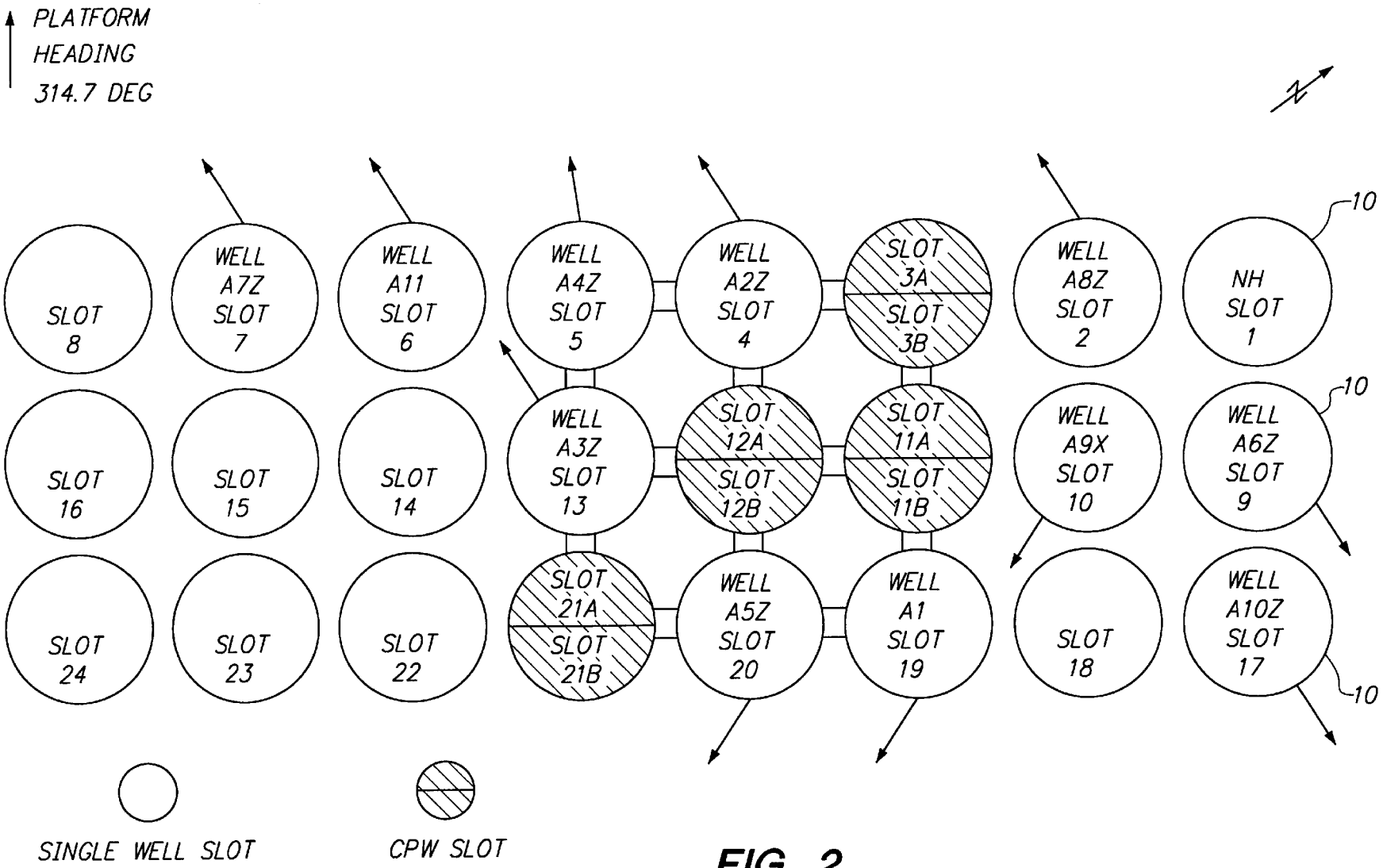
FIG. 2 is a horizontal schematic plan view of slots in an offshore platform, through one of which the multiple wells shown in FIG. 1 are drilled. This view also illustrates the conversion of four conventional slots into four dual well configurations to accelerate development of a petroleum reservoir named the Alba Field.
Figure 3:
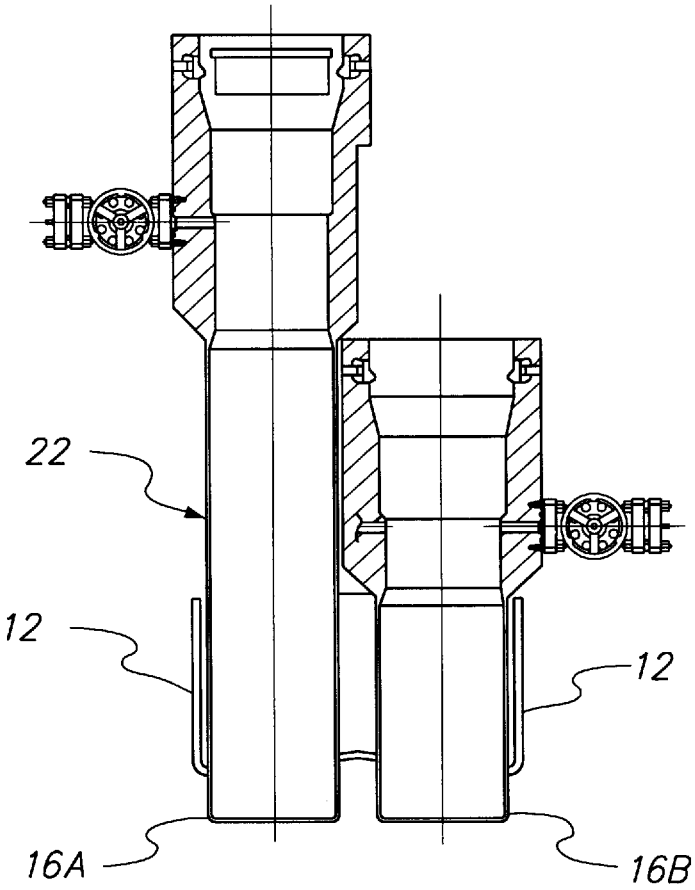
FIG. 3 is a vertical partially cross-sectional view of an early stage of the dual well drilling process of the invention in which two separate conductor casings in this case (nominally 18 inches in diameter), one for each of two CPWs, have been installed in the shroud in this case (nominally 46 inch diameter) and topped with the first wellhead components. These casings are shown extending above the open (top) end of the shroud. As shown, the CPWs have their wellheads at staggered heights to permit independent operation through both bore holes.
Figure 4:
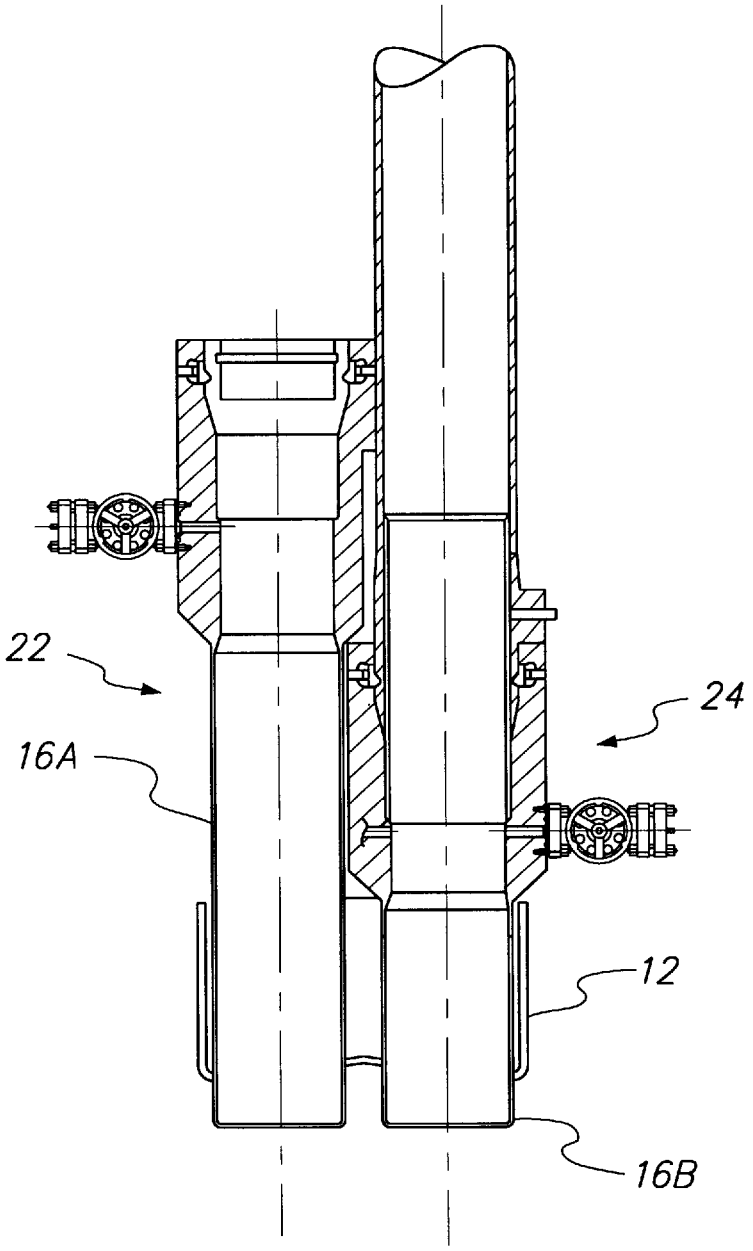
FIG. 4 is a vertical partially cross-sectional view similar to FIG. 3 showing the next stage of the CPW well drilling process of the invention in which the wells are being extended each through the 18 inch conductor strings.
Figure 5:
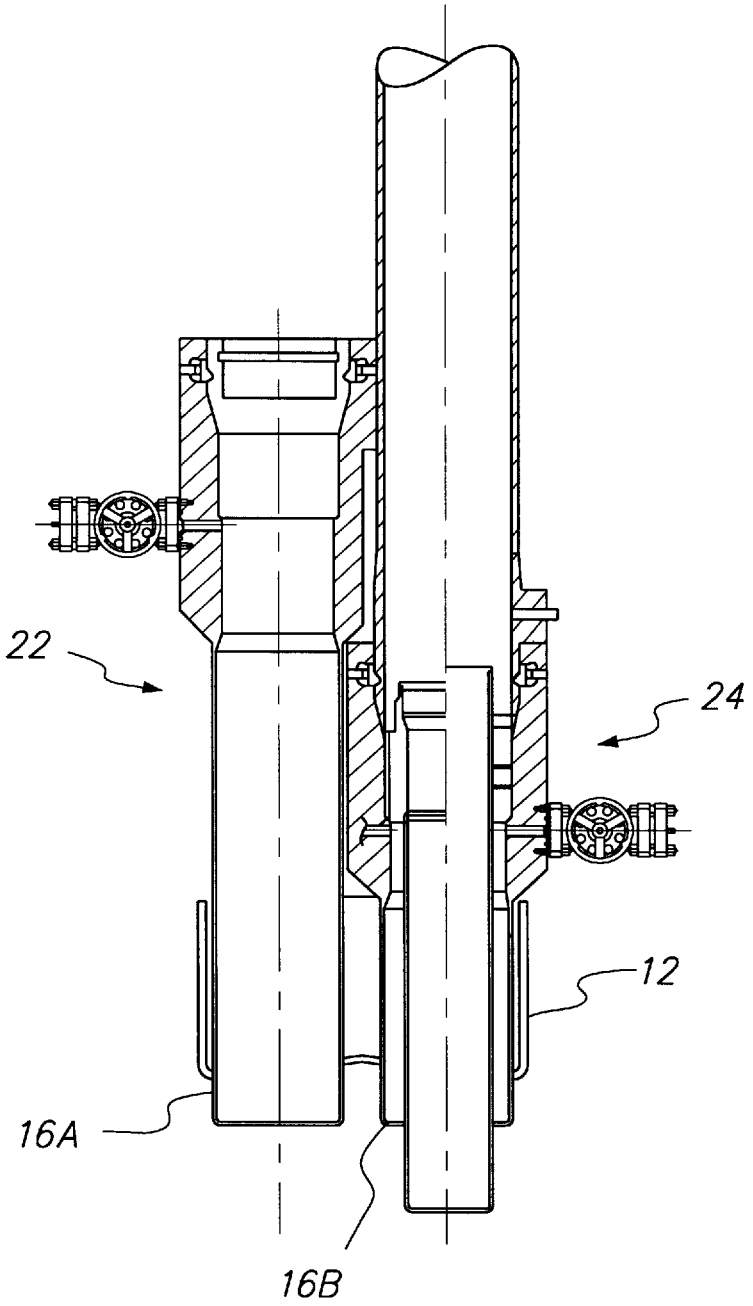
FIG. 5 is a similar view to FIGS. 3 and 4 and shows the next stage of the drilling process, wherein a 13⅜ inch casing string is shown being installed through the 18 inch conductor with its weight being carried on the 18 inch conductor which is in turn carried by the 46 inch shroud.
Figure 6:
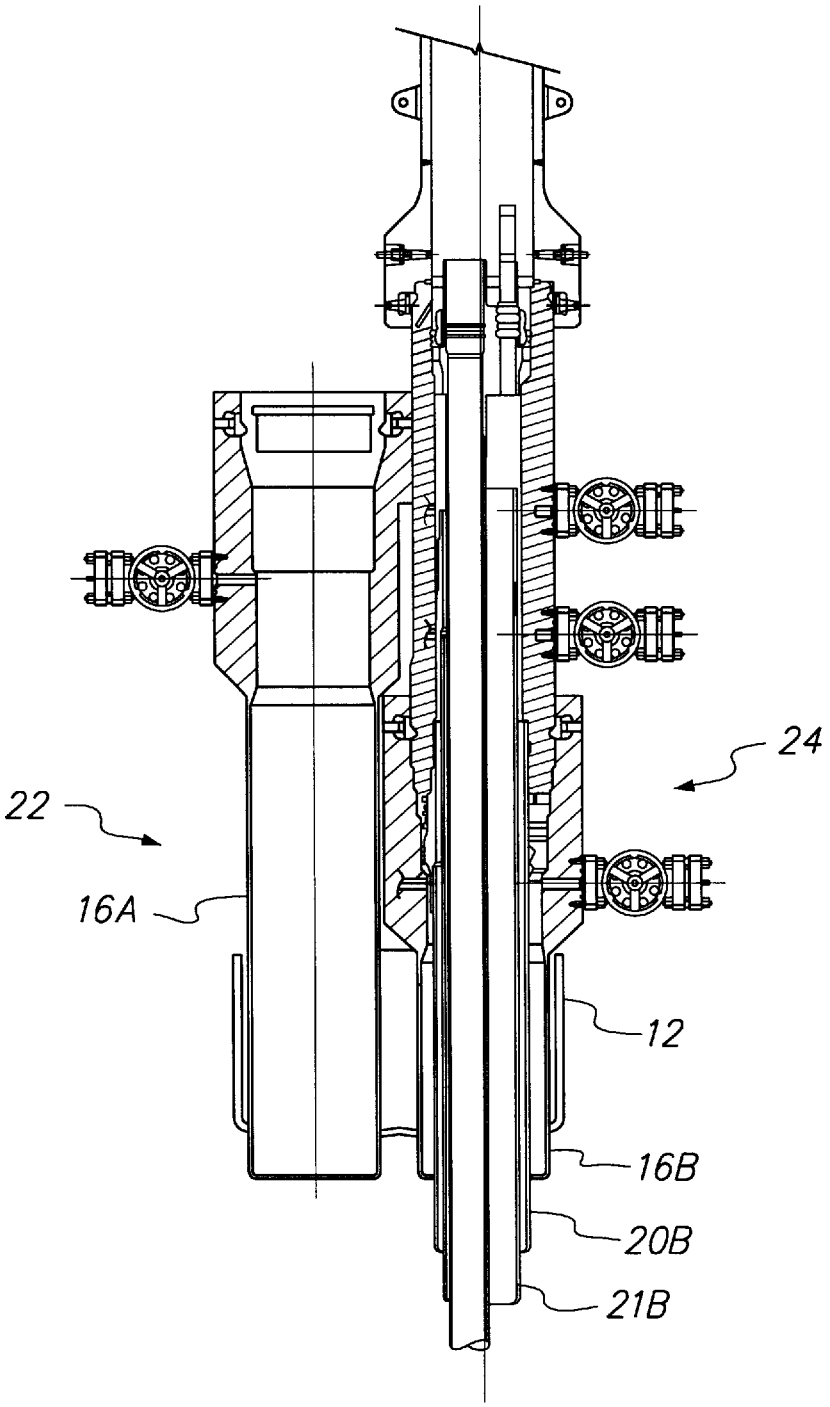
FIG. 6 is a similar view to FIGS. 3–5 and shows the next two stages of the drilling process. In these stages, two more successive drill strings, as indicated, are employed to complete the first drilled CPW. In these stages, one string is used to drill the 12¼ inch hole for setting a 10⅜ inch hanger and wellhead. The producing strings are tubing that complete the multiple supports for the production or injection loads, independent of the slotted platform.
Figure 7:
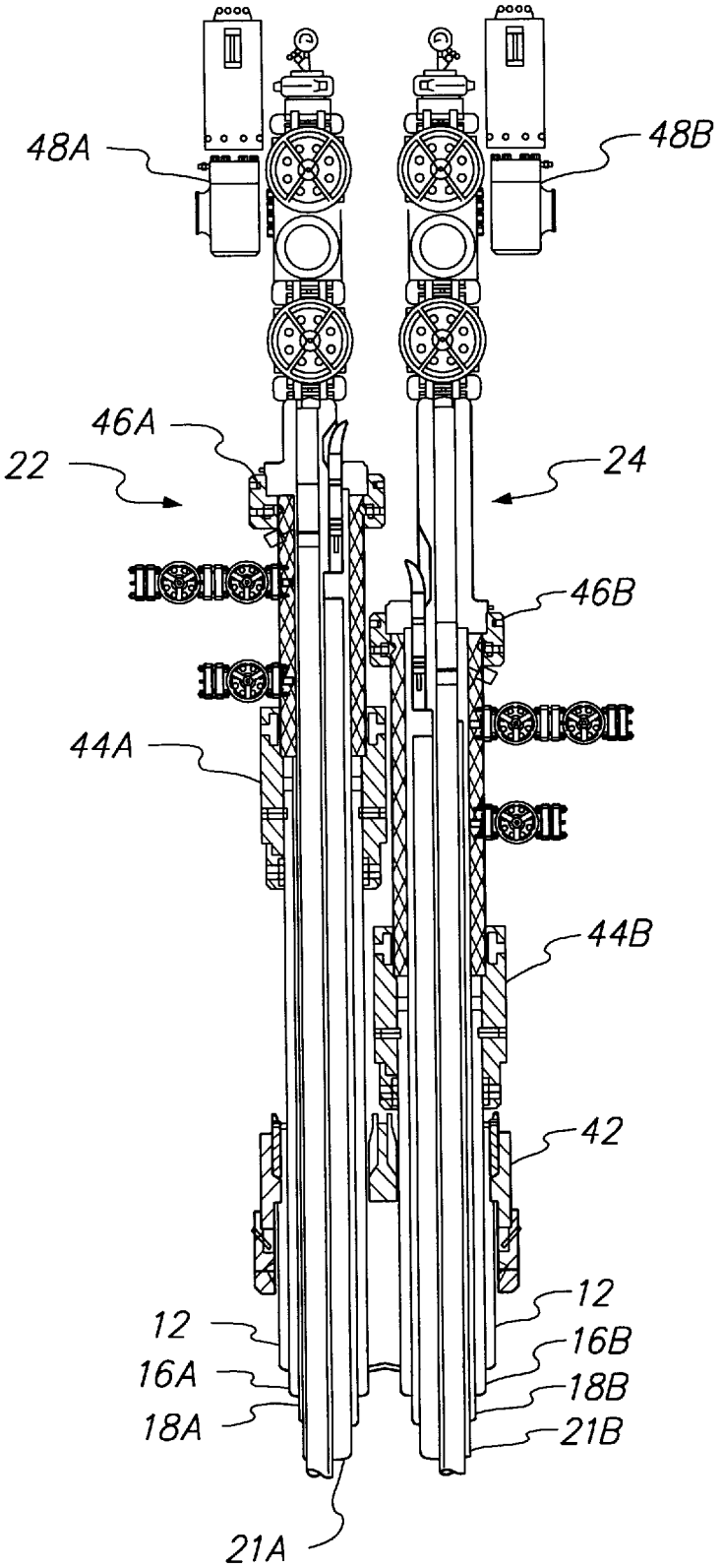
FIG. 7 is a vertical partially cross-sectional view of dual wells produced using this process. This figure shows the two wells positioned within the shroud and supported by the shroud, with their loads being born by the shroud and independent of the drilling platform.

Alba Northern Platform came on stream in January 1994, producing approximately 75,000 bpd (barrels per day) of 20° API oil to a permanently moored floating storage unit with shuttle tanker operations which transports the oil to ports in Western Europe and beyond. As shown in FIG. 2, the Alba Northern Platform is a minimum facilities platform with a limited number of well drilling slots, the allocation of which had to be controlled to assure commercial viability.

A total of twelve wells had been drilled through April 1995, nine horizontal producers and three gravel packed injectors. Peak production has been over 100,000 bpd.

In July 1993 the Alba Southern Area Development study began screening options for exploiting the estimated 400 MMBBLS (STOOIP) in the southern portion of the field. It was recognized that the use of the existing Alba Field infrastructure was crucial to maximizing the economics of the development. The challenge was that Alba had a minimum facilities platform, designed with only 24 slots in its drill platform. As shown in FIG. 2, only slots 3, 11, 12, and 21 were available.

Several means of obtaining more slots were considered. A design premise was to minimize the chances that other existing wellhead systems would adversely affect satisfactory well completions. Conductor slot sharing of two wells, (or "CPW's") was identified as the preferred method since it required no change to the Alba well completions and could employ proven oil field concepts and techniques with little reliance on undeveloped or unproven apparatus.

The area into which the CPWs were to be driven was known to be extremely congested and collision with another well was a concern. Pilot holes were to be drilled to aid directional control. Nearby wells were plugged.

Detailed near surface and soil analyses were carried out which suggested that the first 75 feet, or so, below the mud line would not support the 180 ton load of the shroud between the seabed and the rig floor. In other words, this would be a free fall zone.

The soil studies indicated that the Aberdeen Ground Formation was the first competent formation at a depth of around 900 feet. At that depth the formation had the static bearing capacity to support the estimated loads and also to allow the required 9.0 ppb (pounds per barrel) mud density to be used on the next hole section.

A driving analysis combining the soil and drive pipe data identified the best hammer for this operation. Previous drill/drive experience had shown that circulation ports would be required in the shroud in case a drive/drill/drive operation was required. The ports would also help ensure that cuttings could be removed from the shroud without fracturing the formation at the drive shoe.

Figure 1:
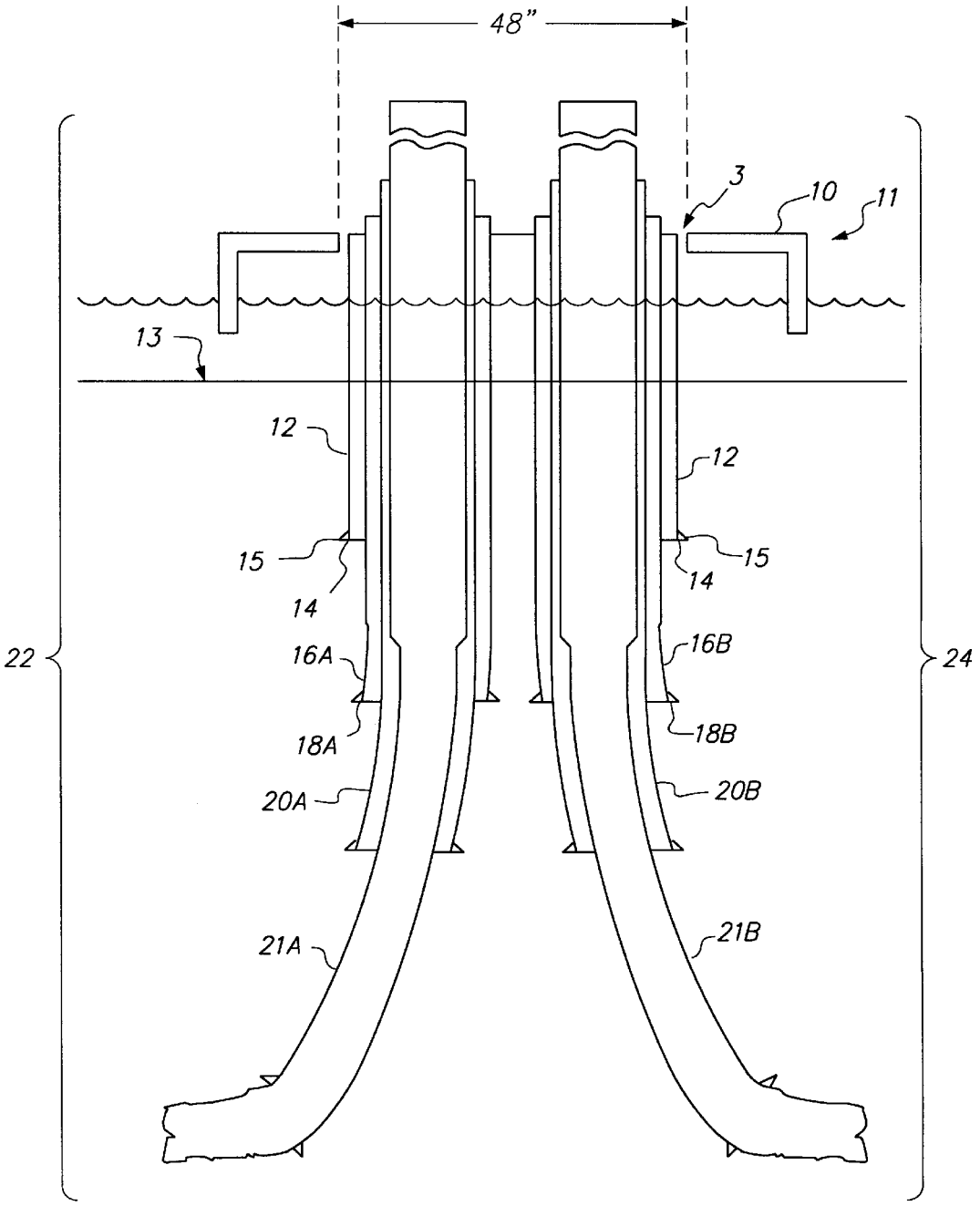
FIG. 1 is a vertical schematic cross-sectional representation of two separate wells drilled through a single slot in the deck of a limited facility offshore work platform. The noted dimensions of the several conductors and casings pipes for each well are illustrative of the method steps and structures of the present invention.

As shown in FIG. 1, an available slot 3 in the deck 10 of drill platform 11 had a useful diameter of about 48 inches.

Wells 22 and 24 were installed into slot 3 in a CPW configuration. Sea level was 196 feet below deck 10. The mud line 13 was 649 feet below deck 10 with a competent formation 15 being located about 250 feet further below at 900 feet.

The rig was equipped with a 37.5 inch rotary table and a 37 inch pitcher nipple which were removed before running the first pipe, the 46 inch shroud 12. In accord with the practice of this invention, a 46 inch diameter drive pipe or shroud 12 having a wall thickness of one inch and a shoe 14 was passed downward through the slot 3 through a spider supported by the rotary beams for driving to the competent formation 15.

The shroud 12 was run to approximately 10 feet above mud line 13 and the scribe line oriented to North. After running a gyro survey, the pipe 12 was run to 720 feet to the base of the free fall zone. A 36 inch pilot hole was drilled down to 850 feet and pipe 12 was then driven to refusal at a depth of 909 feet, a penetration of 269 feet into the competent formation.

Because of load limitations, offshore platform 11 was unable to take any significant amount of the wellhead load of these operations. Thus, shroud 12 had to be free standing, except for the aid of conductor guides which also supported the work load at various elevations on the platform jacket.

Both static strength and dynamic fatigue analyses demonstrated that shroud 12, with a 1 inch wall thickness, would be suitable for the environment requirements. Calculations showed that the greatest bending moment was at or slightly below the mud line and that it would be approximately twice what was observed at the water line.

Prior to driving the shroud 12, it was protected by four different anti-corrosion coatings. The bulk of the pipe was coated with a modified epoxy system to guard against corrosion. Pipe in the marine growth zone is coated with an anti-growth covering. In the splash zone, pipe 12 was coated with polychloroprene embedded with copper-nickel granules to protect against corrosion. The top joint of the shroud had only a mill varnish coating.

At the drivable end of shroud 12 a "quick stab" connector was chosen as being most suitable to operation of the competent formation. Further, this connector had an outside diameter of 47 inches which would reduce external skin friction while driving and so aid shoe 14 to reach the planned depth.

Shroud 12 had four circulation ports (not shown) to allow cuttings disposal while drilling the pilot holes. The ports are located at the point of near zero conductor bending moment, approximately 60 feet about mud line 13. Such apertures are 8 inch by 4 inch ellipses, and were spaced equidistantly around the shroud or caisson 12 and with approximately 5 feet vertical separation. These ports were plugged after driving to prevent corrosion problems resulting from the ingress and flow of oxygenated seawater.

Following seating of shroud 12 at its point of refusal it was cleared of enclosed detritus with a 41 inch assembly and washing tools to provide, in effect, an open caisson 12 extending from the platform into competent formation 15.

Once so installed, this shroud 12 was free standing and did not impose a weight load on platform 11. It was supported vertically by the formations through which it had been driven.

Figure 9:
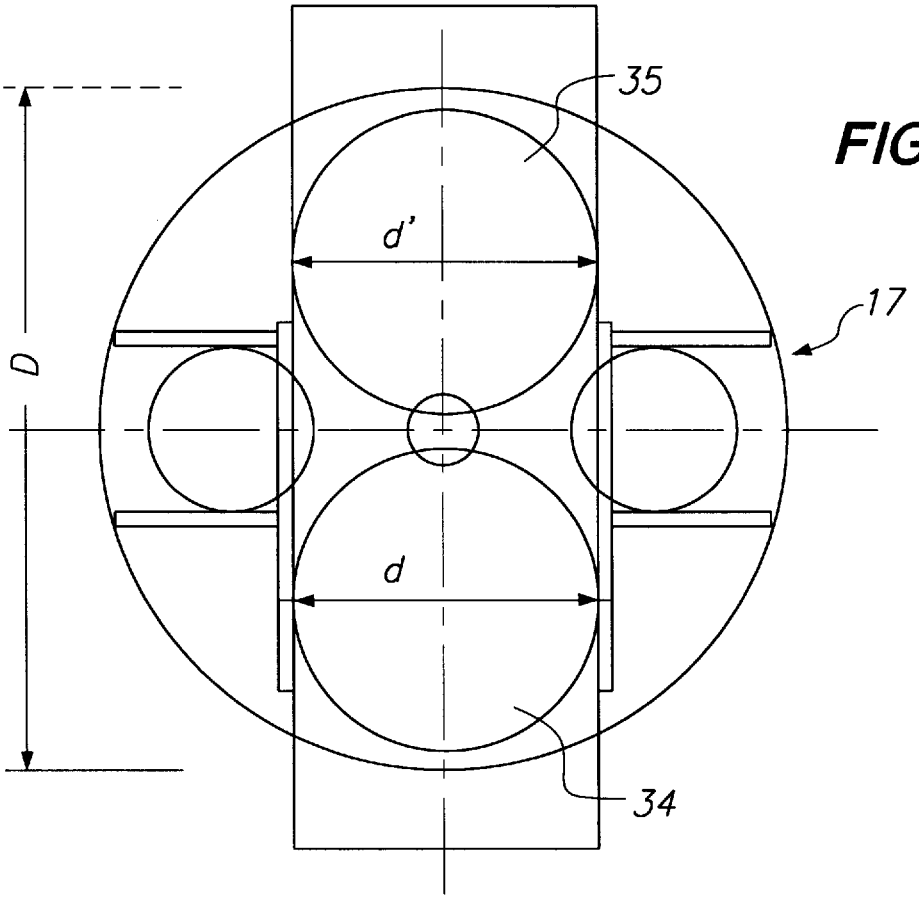
FIG. 9 is a schematic top plan view of a guide for positioning the two 18 inch conductor strings within a 46 inch diameter shroud.
Figure 10:
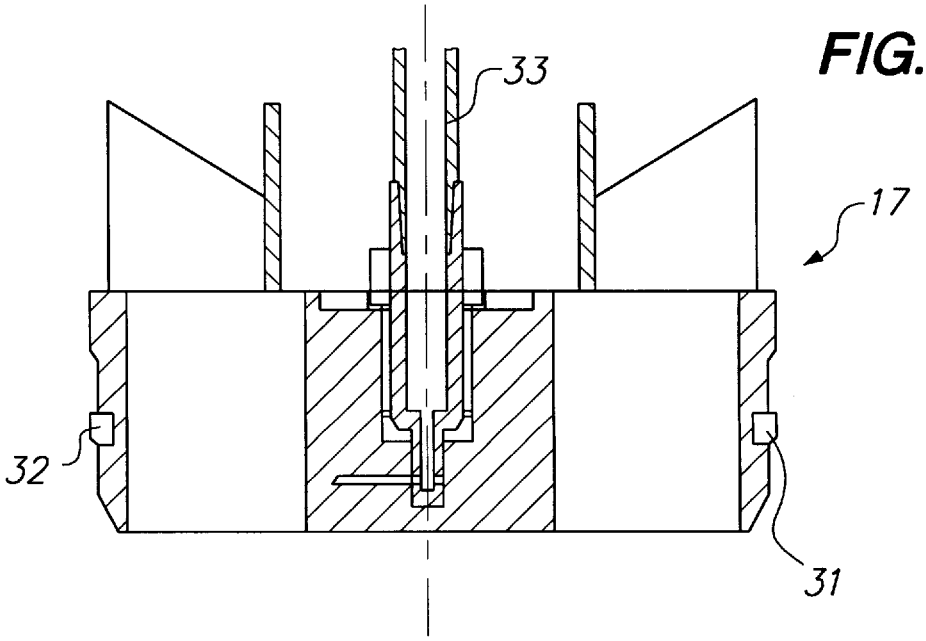
FIG. 10 is a schematic cross-sectional side view of the same guide.

A series of conductor guides 17 were then installed in the open space defined by shroud 12. These guides are not shown in FIG. 1 but are illustrated in FIGS. 9 and 10. Their installation sequence is depicted in the first three views of FIG. 8.

Guide 17 is cylindrical with a diameter D which permits the guide 17 to be run down the shroud 12. (That is, it has a diameter somewhat less than 46 inches.) Guide 17 includes dogs 31 and 32 which can be deployed to engage a load shoulder 36 provided on the inner surface of shroud 12 and lock guide 17 to the shroud 12 after the guide has been lowered to its desired position within caisson 12 by running tool 33. Once at the proper depth, guide 17 is rotated to the right to set dogs 31 and 32 on the load shoulders 36. Thereafter, the drill string 33 is rotated in reverse to back the running tool out of the guide and leave it positioned in the caisson.

The several guides (one per well in the case of the Alba wells) were aligned with one another rotationally so as to define a plurality of conductor paths 34 and 35 down through shroud 12 and spaced along the length of shroud 12 with one preferably located at the lower end of shroud 12, that is, adjacent to shoe 14. The several guides each carry a plurality of circular apertures 34 and 35 having diameters d and d' respectively were each sized to accept a cylindrical conductor 16A or 16B. As shown, d and d' are typically equal, for example 18.25 inches, but could be different, if desired.

The guides have two major openings functions. They align the subsequently fed conductors and separate them and they serve as weight bearing elements supporting the subsequent conductors on the caisson when called for. Those guides 17 were run on drill pipe 33 and set in with dogs 31 and 32 to permanently locate them.

Since there was clearly room inside the 46 inch diameter of shroud 12, two separate strings, somewhat greater than the 18 inch diameter selected, could have been used, but the trade off was inadequate separation of the wellheads. The 18 inch diameter served to provide a good compromise. Dynamic and static fatigue analysis of the tubulars and connections confirmed that 18 inch diameter pipe with 0.5 inch wall thickness was suitable and did not require centralization.

Next, a dual bore head was positioned upon shroud 12. It was designed to provide maximum separation of the pair of wells within the caisson and to permit tensile loads to be distributed between the inner surface of shroud 12 and the outer surface of conductor strings 16*a* and 16*b* when they were installed.

Sections of conductor strings 16 were connected by flush joints to minimize any risk of interference between each other. Centralizing the two strings inside the caisson without the conductor guides and dual bore head would have been very difficult.

At shroud 12's 46 inch shoe 14 kick off depth, the center lines of conductor strings 16A and 16B are only 22 inch apart. It was therefore critical to increase separation of the two wells 22 and 24 immediately after the kick off point. This was achieved through careful slot allocation and directional planning so that the two wells would have paths emerging from the base of the shroud that would be in opposite directions. To further aid separation, shoes 19A and 19B were also kicked off at different depths.

The two wells 22 and 24 were kicked off from the base (shoe 14) of shroud 12. It is the proximity of the two wells 22 and 24 within the shroud and the wellheads on the platform that leads to the term "Close Proximity Wells" (CPWs). The CPWs enabled the drilling of 28 wells efficiently and economically from a platform originally equipped with 24 slots. FIG. 2 shows a schematic layout of the close proximity wells in this platform.

Running Conductors 16—Stage 1. Once the 46 inch dual bore-head had been installed over the top of shroud 12, the drill rig was skidded over the center of the northern bowl. The first string in slot 3A, 18 inch conductor string 16A, had flush joints on the outside of casing 16 with a 19 inch shoe joint 18. It was run to 10 feet off bottom as shown in the fourth view of FIG. 8 and then hung off from the 46 inch starter head in shroud 12. The rig was then skidded 23 inches over the center of the southern bowl and the second well string 16B was run to 10 feet off bottom. This string was hung off the rig floor.

Running Conductors 16—Stage 2. A steerable assembly with a 16 inch bit was used to drill the shoe 18 depth at 1300 feet TVD, (true vertical depth). This was later opened out using an underreamer to 22 inch diameter. String 16B was run to bottom and cemented, but only 200 feet above the 18" casing shoe was sealed. An inflatable packer was used in the hole to prevent cement entering shroud 12 above the guide collars.

When the cement set, the casing was rough cut ready to permit installing the casing head.

Running Conductors 16—Stage 3. String 16A was tied back to the rig floor. A false table was used to drill the approximately 400 feet of 16 inch hole and then underreamed to 22 inch diameter. This section was oriented between 90° and 180° from the first well. Drilling parameters were closely monitored to quickly identify any interference with the adjacent well.

Figure 8:
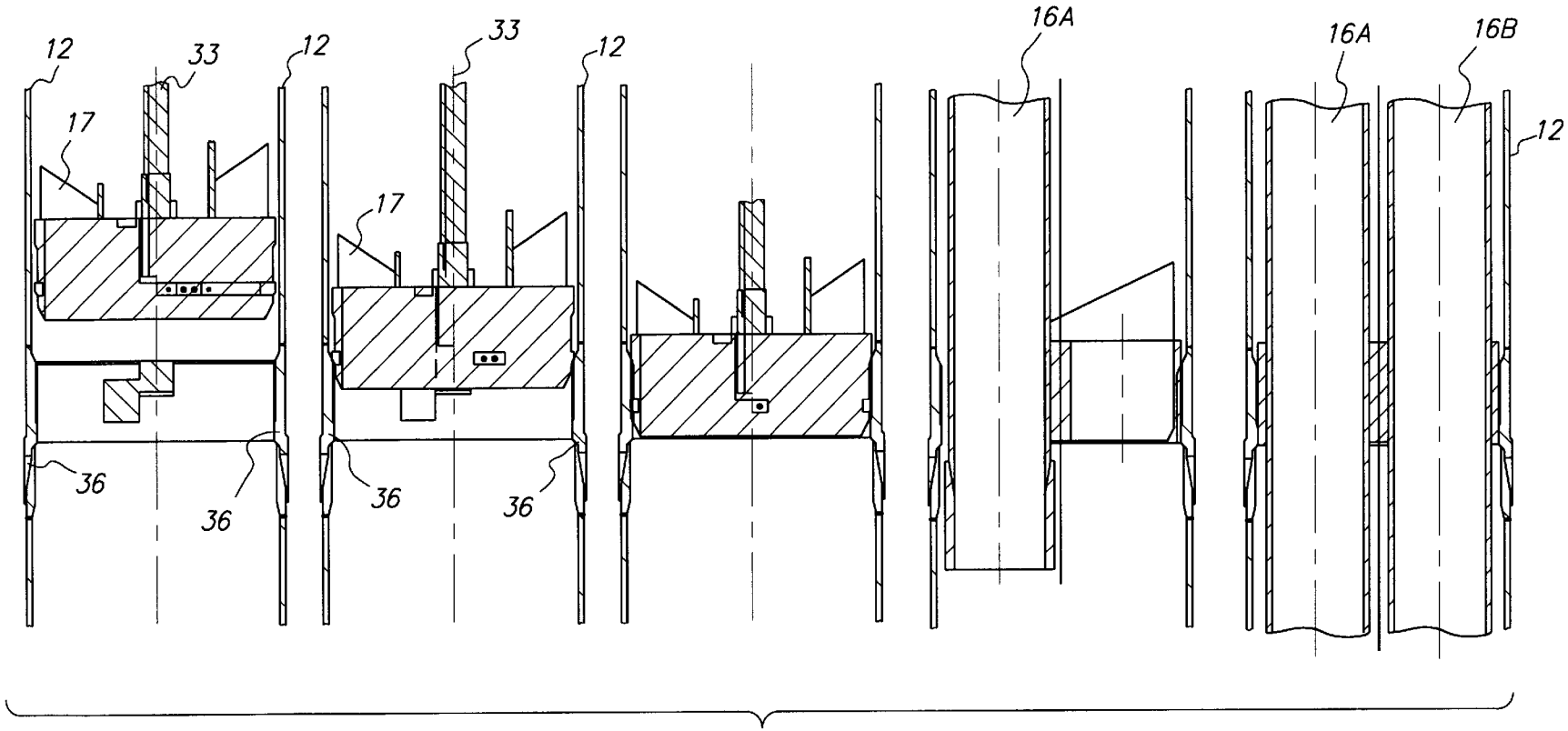
FIG. 8 is a series of five vertical cross-sectional views of a portion of a CPW drilling assembly of this invention showing a hole guide locked to the inner wall of the drilling caisson and providing a load bearing surface upon which the drill strings can be suspended. In the different views successive stages of the drilling process are illustrated as the two 18 inch conductor strings are independently run to bottom.

The 16A string was run to its target TVD as shown in the fifth view of FIG. 8 and cemented from the casing shoe to 25 feet BML (to facilitate future abandonment). Tubing was run between the shroud and the outer side of conductors 16A and 16B to tag the top of the cement. A "top up" job would be performed if TOC (top of cement) were more than 25 feet BML.

Thereafter, additional casting strings were run through each of the two conductors 16A and 16B to extend the wells. The initial casing was 13⅜ inch 20A and 20B to 3000 TVD and finally 9⅝ inch by 10¾ inch pipe 21A and 21B to about 6500 TVD. In all cases, the weight of these casings and is carried on shroud 12 rather than upon drill platform 11.

Figure 11:
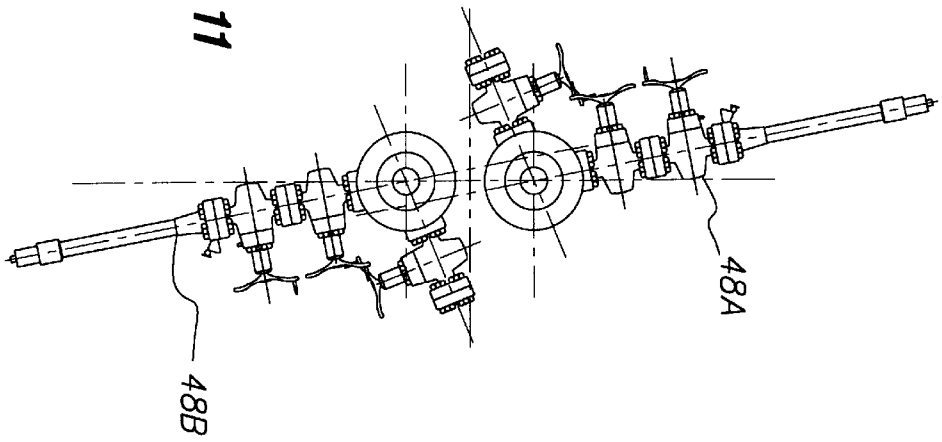
FIGS. 11 and 12 are top plan views of a dual production wellhead layout, with FIG. 11 illustrating the wellheads and FIG. 12 the relationship of the two Christmas trees.
Figure 12:
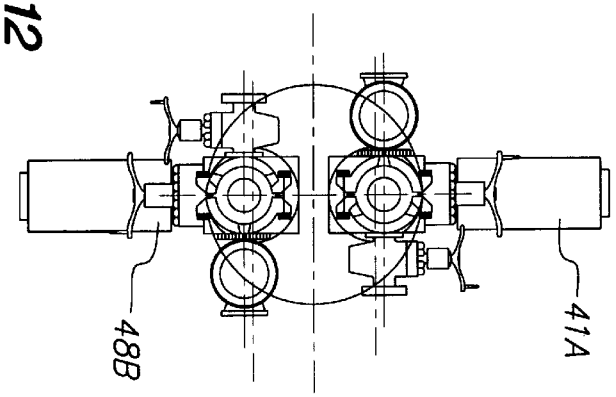
Figure 13:
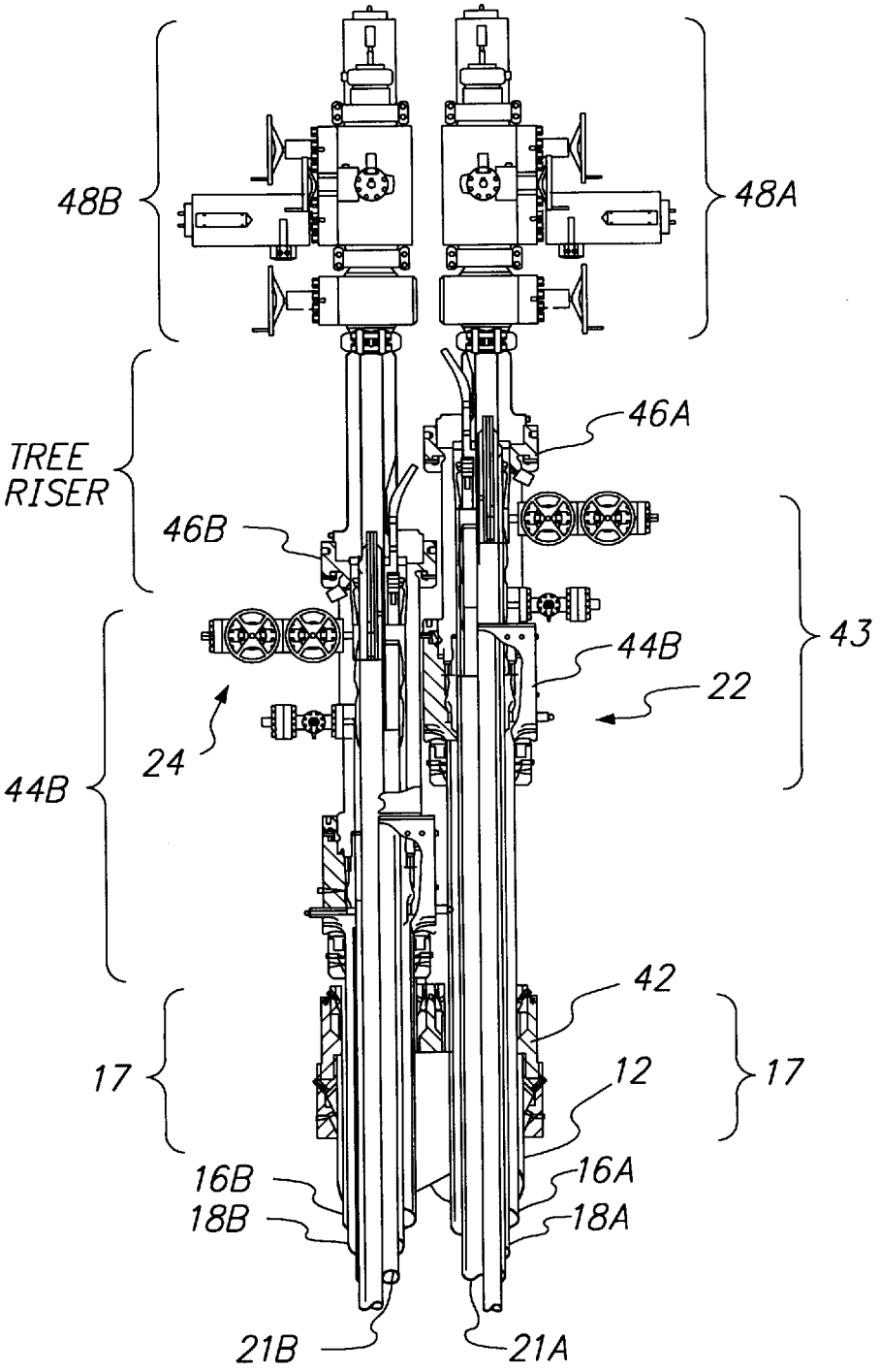
FIG. 13 is a partially cross-sectional elevational view of a pair of CPW's in accordance with this invention.

Wellheads: The wellhead installations are shown in sequence in FIGS. 7 and 11–13. An advantage was to minimize any new equipment and retain the same style of the original wellhead. The wellhead system consists of the 46 inch dual bore head 42, and, for each CPW, an 18 inch casing head 44, as a multibowl assembly which included a tubing bonnet 46 a Christmas tree 48 and tree recess 22 and 24. The close proximity of the wellhead systems required them to be staggered, as shown in FIG. 11.

What is claimed:

1. A method for drilling a plurality of wells from a single slot on a platform comprising a. installing a cylindrical shroud having weight-bearing walls and a hollow interior of preselected diameter through the slot to a competent weight-bearing formation below the drilling platform;

b. clearing the hollow interior of the shroud, thereby creating a clear weight-bearing caisson with the preselected interior diameter running from the platform to the competent formation with a first end at the platform and a second end at the competent formation;

c. installing a plurality of generally cylindrical guides within the hollow interior of the caisson spaced over the length of the caisson, with at least one of the guides being at or about the second end, these guides each having an outside diameter just smaller than the interior diameter of the caisson and each carrying a plurality of separate, noncentered axially oriented cylindrical apertures, the guides being aligned axially with one another to provide a plurality of separate distinct cylindrical paths over the length of the caisson;

d. installing a first well conductor through a first of the plurality of separate distinct cylindrical paths, said first conductor being supported by the caisson;

e. installing a second well conductor through a second of the plurality of separate distinct cylindrical paths, said second conductor also being supported by the caisson;

f. extending the first conductor beyond the second end of the caisson into the competent formation; and g. extending the second conductor beyond the second end of the caisson into the competent formation.

2. The method of claim 1 wherein the plurality of wells is two wells and the plurality of distinct cylindrical paths is two paths.

3. The method of claim 1 wherein the guides are each locked to the inside of the weight-bearing walls of the caisson.

4. The method of claim 1 wherein the installing of step a is driving or drilling then cementing the caisson in place.

5. The method of claim 1 wherein the installing of steps d and e and the extending of steps f and g are carried out with weight being borne by the weight-bearing walls of the caisson.

6. The method of claim 1 additionally comprising after step a. the step a'. extending the shroud into the competent formation.

7. A method for increasing the underground-well-drilling capacity of a preexisting facility having a plurality of preexisting drilling slots comprising;

a. selecting one of the plurality of drilling slots;

b. installing a first cylindrical shroud having weight-bearing walls and a hollow interior through the selected slot to a competent weight-bearing formation below the drilling facility or platform;

c. clearing the hollow interior of the shroud, thereby creating a clear weight bearing caisson running from the drilling platform to the competent formation with a first end at the drilling platform and a second end at the competent formation;

d. installing two or more generally cylindrical guides within the hollow interior of the caisson spaced over the length of the caisson, with at least one of the guides being at or about the second end, these guides each having an outside diameter just smaller than the interior diameter of the caisson and each carrying a plurality of separate, noncentered axially oriented cylindrical apertures, the guides being aligned axially with one another to provide a plurality of separate distinct cylindrical paths over the length of the caisson;

e. installing a first underwater well conductor through a first of the plurality of separate distinct cylindrical paths, said first conductor being supported by the caisson;

f. installing a second underwater well conductor through a second of the plurality of separate distinct cylindrical paths, said second conductor also being supported by the caisson;

g. extending the first conductor beyond the second end of the caisson into the competent formation; and h. extending the second conductor beyond the second end of the caisson into the competent formation.

8. The method of claim 7 wherein the plurality of wells is two well and the plurality of distinct cylindrical paths is two paths.

9. A close proximity well system for producing fluid products from underwater formations comprising:

a drill platform or facility having a deck having at least one drilling slot located above the water or soil which is in turn above a competent load bearing formation;

a hollow cylindrical caisson extending from the drilling slot in the deck to the competent load-bearing formation, said caisson having weight-bearing walls and a hollow interior of preselected diameter, and a first end at the drilling platform and a second end at the competent formation;

two or more generally cylindrical guides within the hollow interior of the caisson spaced over the length of the caisson, with at least one of the guides being at or about the second end, these guides each having an outside diameter just smaller than the interior diameter of the caisson and each carrying a plurality of separate, non-centered axially oriented cylindrical apertures, the centers being aligned axially with one another to provide a plurality of separate distinct cylindrical paths over the length of the caisson;

a first underwater well conductor located within a first of the plurality of separate distinct cylindrical paths, said first conductor being supported by the caisson and extending beyond the second end of the caisson into the competent formation; and a second underwater well conductor located within a second of the plurality of separate distinct cylindrical paths, said second conductor also being supported by the caisson and extending beyond the second end of the caisson into the competent formation.

10. The close proximity well system of claim 9 wherein the first well conductor extends into a fluid-product-containing formation.

11. The close proximity well system of claim 9 wherein the first and second well conductors each extend into a fluid-product-containing formation.

12. The close proximity well system of claim 9 wherein the first and second well conductors each extend into different areas of one or separate fluid-product-containing formations.

* * * * *